United States Patent [19]

Rommel

[11] 4,226,097

[45] Oct. 7, 1980

[54] DEVICE FOR APPLYING LIQUIDS ONTO A CONTINUOUSLY-RUNNING WEB

[75] Inventor: Heinz Rommel, Seevetal, Fed. Rep. of Germany

[73] Assignee: Artos Dr.-Ing Meier Windhorst KG, Seevetal, Fed. Rep. of Germany

[21] Appl. No.: 36,956

[22] Filed: May 7, 1979

[51] Int. Cl.[3] ..... D06B 1/06

[52] U.S. Cl. ..... 68/205 R; 118/325

[58] Field of Search ..... 68/200, 205 R; 118/324, 118/325; 222/403, 414

[56] References Cited

U.S. PATENT DOCUMENTS

| | | | |
|---|---|---|---|
| 1,358,857 | 11/1920 | Kraut | 222/403 X |
| 1,834,435 | 12/1931 | Steere | 222/403 X |
| 3,995,581 | 12/1976 | Smejda | 118/412 X |
| 4,127,014 | 11/1978 | Miller et al. | 68/205 R X |

FOREIGN PATENT DOCUMENTS

| | | | |
|---|---|---|---|
| 690456 | 6/1930 | France | 222/414 |
| 9707 | of 1903 | United Kingdom | 68/200 |

*Primary Examiner*—Philip R. Coe

*Attorney, Agent, or Firm*—Allison C. Collard; Thomas M. Galgano

[57] ABSTRACT

A device for applying liquids onto continuously-fed textile webs and, in particular, carpet webs is provided wherein the liquid is initially removed from a liquid-supply container by means of rollers which are immersed in the liquid. The liquid is then wiped off from the roller surface and is fed onto the web of goods. The invention is characterized by the provision of rollers having a profiled surface into which a wiper positively engages with its associated wiper edge.

13 Claims, 7 Drawing Figures

DEVICE FOR APPLYING LIQUIDS ONTO A CONTINUOUSLY-RUNNING WEB

The present invention relates to a device for applying liquids onto continuously-fed textile webs. More particularly, it relates to such a device wherein the liquid is initially removed from the liquid container by means of rollers which are immersed into the liquid and is subsequently wiped off from the roller surface and fed onto the web of goods.

Various devices of this type are well known and are also in wide use. All of these known conventional devices have a roller which has a uniformly smooth roller surface and a wiper which extends over the total width of the roller, so as to wipe off the liquid film from the roller. These systems permit a liquid application with only one defined liquid per application. When operating with a plurality of different liquids it is required to provide a plurality of application devices which is expensive.

This situation does not change even if, as was previously suggested, the liquid film which is wiped off from the roller surface is fed into individual streams on the sheet metal wiper element. As a result thereof, an application of the liquid on the web of goods is obtained, provided that no other additional application possibilities are taken into consideration. Here too, a plurality of application devices are required, if different liquids have to be applied.

It is an object of the invention not only to apply larger liquid quantities onto the web of goods with one single device, but also to simultaneously apply a plurality of different liquids onto the web of material with one single device.

These objects of the invention are obtained by the provision of rollers having a profiled surface into which the wiper positively engages with its associated wiper edge. Obviously, the surface of a profiled roller is considerably larger than a corresponding smooth roller. Therefore, in contrast to the corresponding known systems, it is possible to apply substantially larger liquid quantities onto the web of goods with respect to the roller length and cross-section. Consequently, with one individual roller the same quantity of treatment liquid may be applied to the web of goods for which, heretofore, a plurality of rollers and application devices having the same dimensions were required.

In a preferred embodiment of the invention, the rollers are provided with a tooth-like profile. In this case, the roller may consist of one unitary roller or the roller may consist of a plurality of teeth or individual discs which are assembled into one roller. This is advantageous because it is possible, with simple means, to make rollers having different widths, thus reducing the costs involved.

In a known manner the wiper means may consist of one unitary wiper plate which is provided with a modified wiper edge, as previously mentioned, having a profile corresponding to the roller profiles. The wiper may also be composed of individual cup-shaped wipers, in which case the wiper edge is so constructed that each cup-shaped wiper encompasses one or a plurality of wiper teeth. Such an embodiment has specific advantages, because the individual wiper cups can be easily made in the form of stamped-out elements or pieces and may be easily assembled into wipers of different widths.

Separate liquid containers, for example, for different treatment liquids, may be provided for each tooth or for a plurality of adjacent roller teeth. This is advantageous in that with one single inventive device a plurality of different dyes may be simultaneously applied to the web of goods. The liquid containers associated with each roller, or a group of roller teeth, may be in the form of individual containers; it being necessary to couple containers containing the same dye with each other by means of hoses, so as to obtain even liquid levels in all containers. However, the liquids may be contained in one large unitary container which is separated by lateral walls into a plurality of individual containers containing different liquids. Here too, it is essential to couple individual container segments which contain the same dye with each other.

It has been shown to be desirable to vary the immersion depth of the rollers into the treatment liquid. By changing the immersion depth of the rollers into the treatment liquid, the removal and further feeding of the treatment liquid to the web of goods may be varied. This varying of the immersion depth can occur by the provision of vertically or heightwise adjustable rollers. However, it is also possible to adjust the liquid level in the individual container segments such as by means of liquid overflows. In this manner, it is possible to apply the treatment liquid in different quantities at different locations with only one individual application device, provided that the liquid level of adjacent containers is adjusted at different heights.

Other objects and features of the present invention will become apparent from the following detailed description considered in connection with the accompanying drawings which disclose several embodiments of the invention. It is to be understood, however, that the drawings are designed for the purpose of illustration only and not as a definition of the limits of the invention.

In the drawings, wherein similar reference characters denote similar elements throughout the several views.

Figure 1:
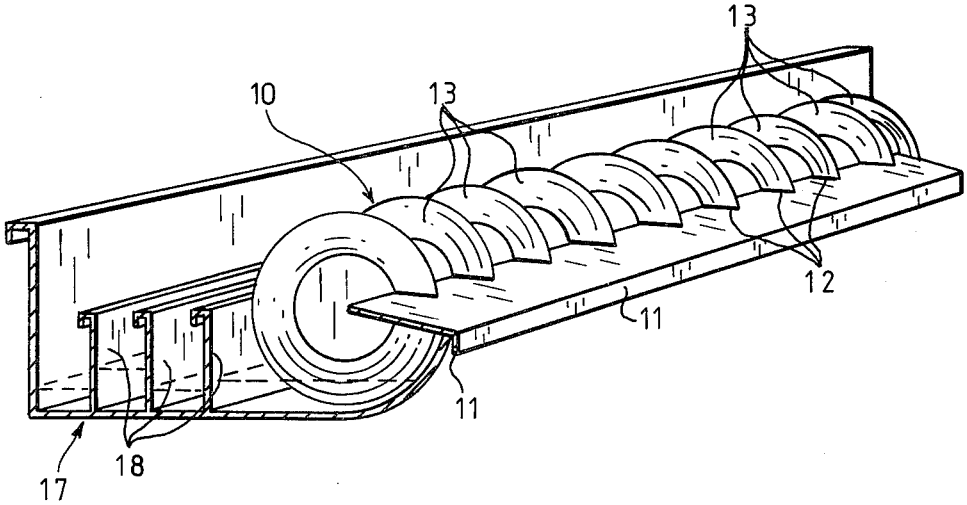
FIG. 1 is a perspective view of a device in accordance with the invention having a continuous smooth wiper.

Turning now in detail to the drawings, and with particular reference to FIG. 1, a roller 10 is provided, which consists of a plurality of roller teeth or discs 13 partially immersed in a liquid container 17. In this embodiment, a smooth wiper 11 engages the surface of roller 10. The liquid is fed from the wiper along its total width onto the web of goods (not shown) which runs beneath the wiper. The drawings also show that the liquid container 17 is separated into segments by walls 18, indicating that the liquid container is suited for receiving different liquids, for example, liquids having different colors.

Figure 2:
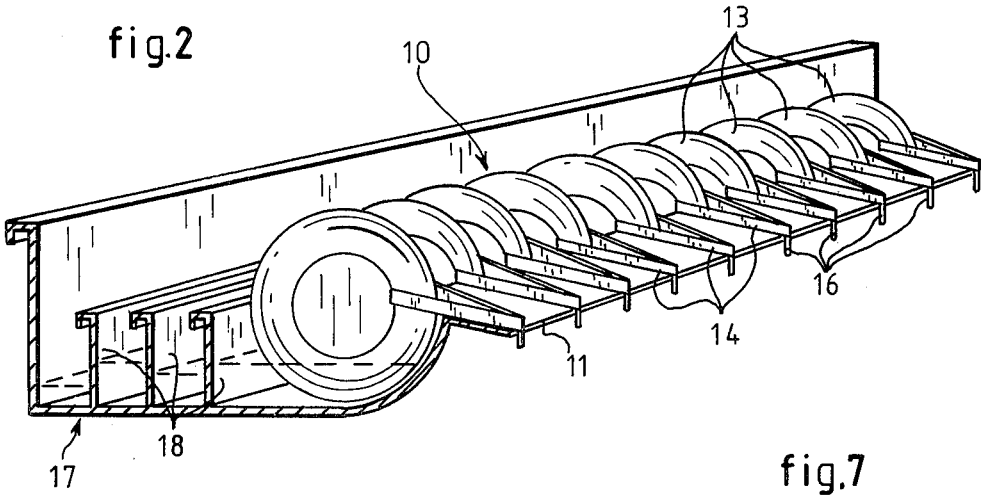
FIG. 2 is a perspective view of an alternate embodiment wherein the inventive device is provided with individual wiper cups.

The embodiment shown in FIG. 2 is substantially the same, with the only difference being that the individual wiper plate 11 inludes a plurality of cup-shaped wipers 14 which receive the liquid which is wiped-off from each tooth of roller 10 from which the liquid is further fed through hose couplings 16. It is also possible that a different dye is wiped off by each roller tooth and applied to the web of goods.

Figure 3:
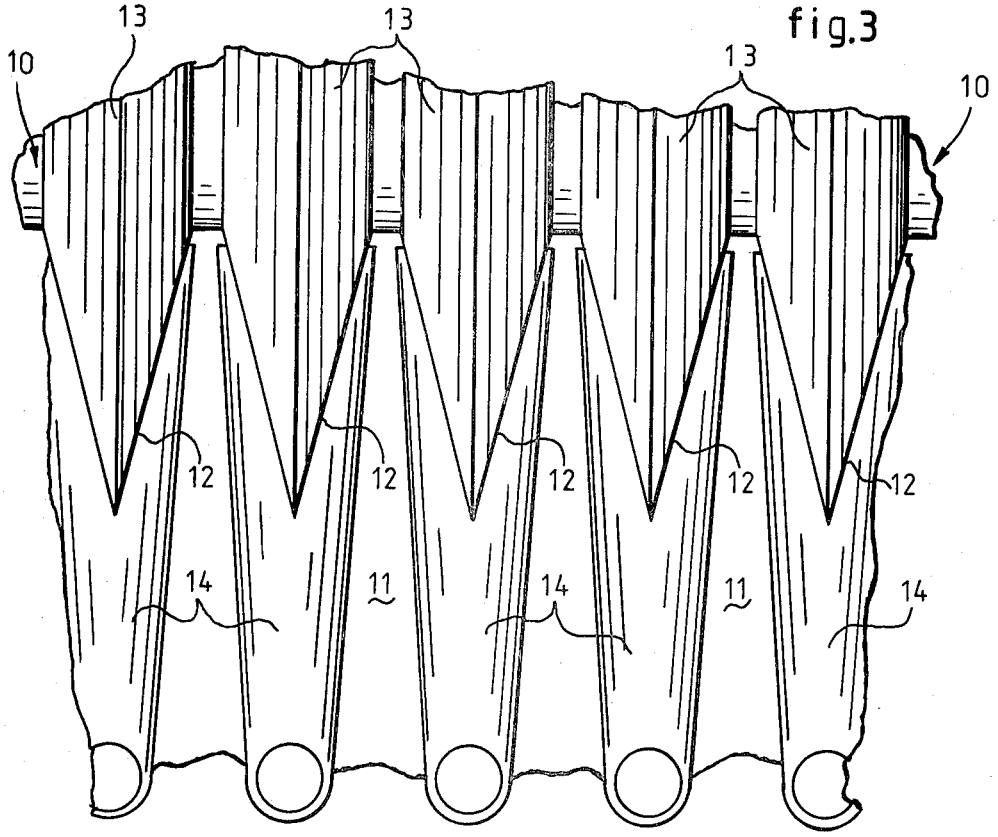
FIG. 3 is a fragmentarily-illustrated plan view of a portion of the device shown in FIG. 2, illustrating the arrangement of the equally-long wiper cups with the associated roller teeth.
Figure 4:
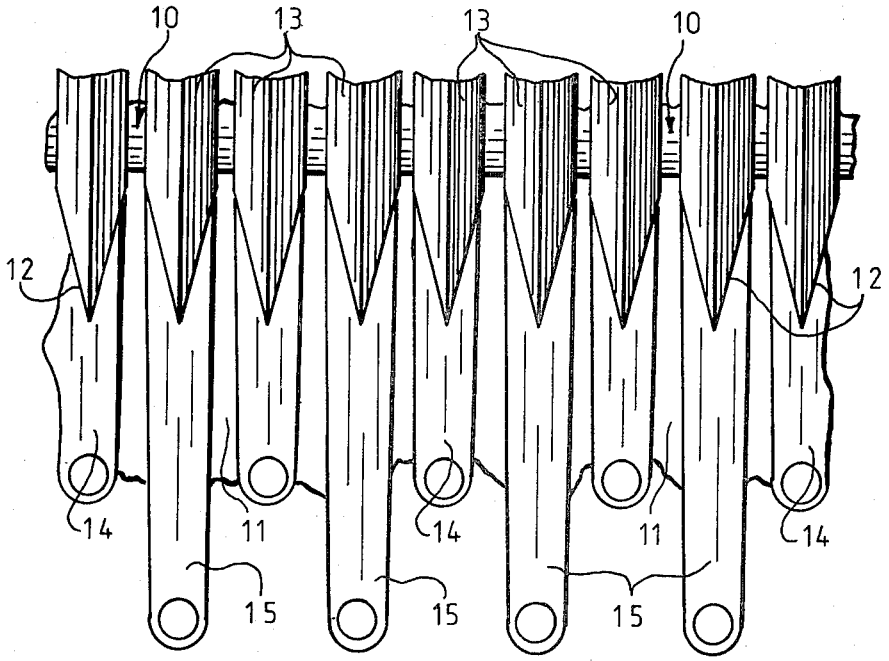
FIG. 4 is a view comparable to that of FIG. 3, but showing the alternate employment of short and long wiper cups.

FIGS. 3 and 4 show in plan view the disposition of the wiper cups 14. In FIG. 3 all wiper cups are equal in length and, in FIG. 4, short and long wiper cups 14 and 15, respectively, alternate with one another. With such an arrangement it is possible to apply the liquid which is wiped off from the roller 10 in different planes onto the web of goods.

Figure 5:
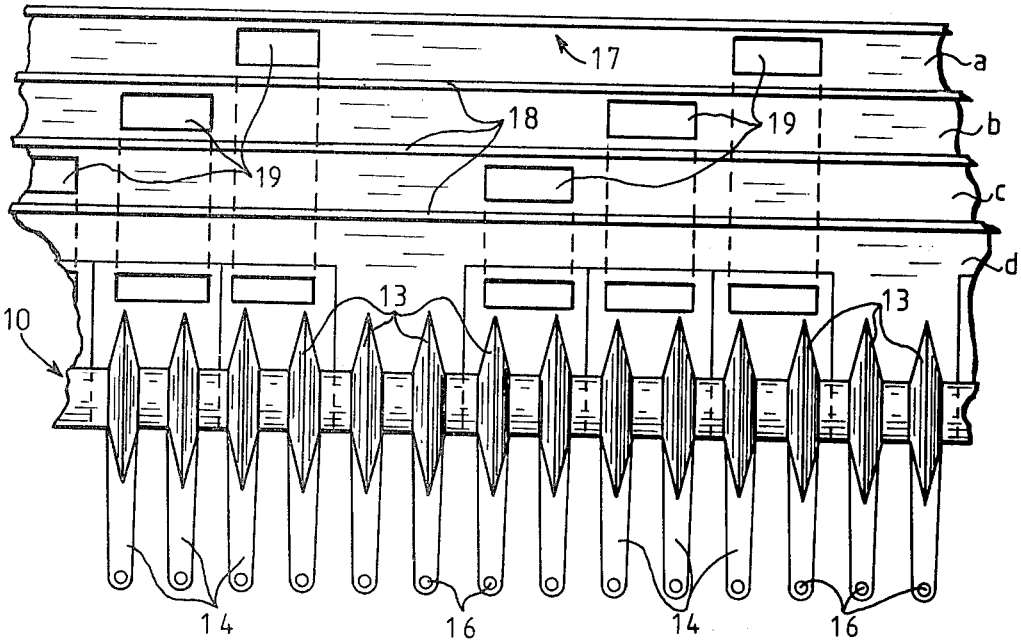
FIG. 5 is a schematic plan view of the device shown in FIG. 2, showing the roller and associated wiper cups and liquid containers.

The complete device as shown in the schematic plan view of FIG. 5 shows roller 10 with the associated individual roller teeth 13 and the wiper cups 14 disposed in front thereof. As can also be seen in FIGS. 1 and 2, roller 10 is partially immersed in liquid container 17 which, in the illustrated embodiment, is separated into segments by separating walls 18 containing different liquids. In this manner, four different containers are obtained which are designated by reference letters a, b, c and d. The drawing shows that two roller teeth are combined and that each pair is coupled with one of the liquid containers a–d. This arrangement is repeated over the total width of the roller, and it can be seen that between each of the two roller teeth, separating walls 18 and connections 19 are provided which connect the liquid containers with the liquid-collecting container. Naturally, it is possible to provide a completely different configuration for the liquid containers. For example, a plurality of individual containers, which are essentially connected with each other by means of hose couplings, so as to maintain a uniform liquid level in all of the containers which are associated with each other.

Figure 7:
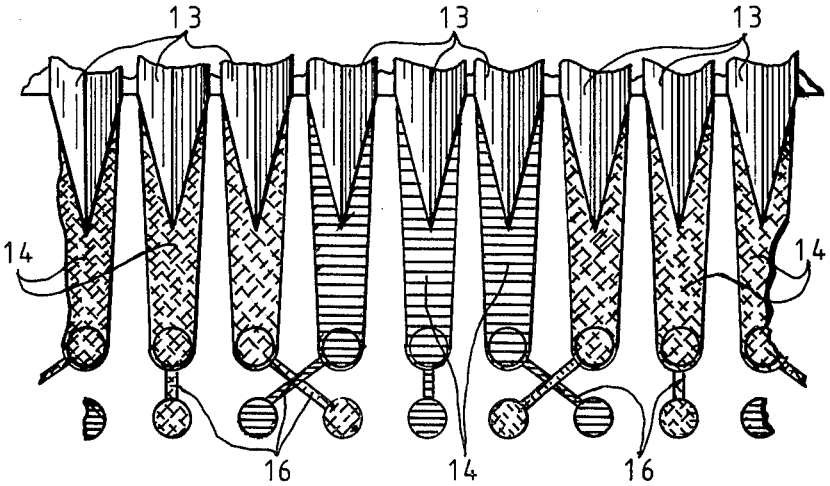
FIG. 7 is a view comparable to that of FIG. 6, but showing a further arrangement for controlling the liquid streams.
Figure 6:
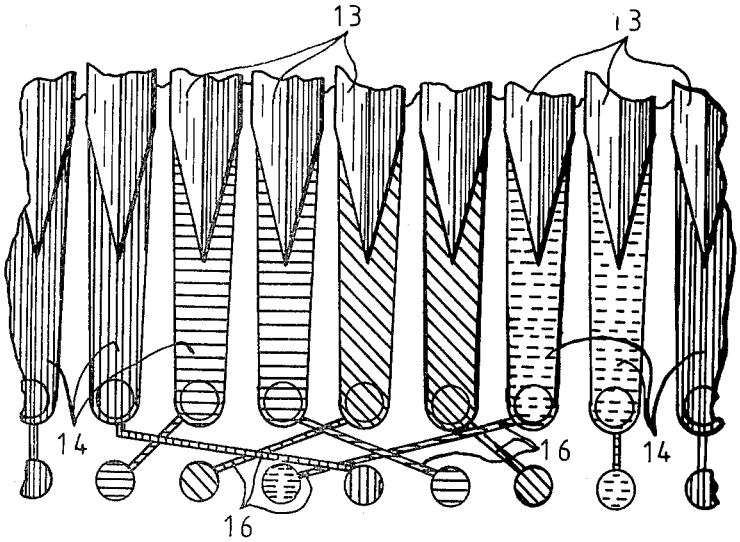
FIG. 6 is a fragmentarily-illustrated, partially schematic plan view of an arrangement for controlling the liquid fed from the wiper cups.

The liquid which is wiped off from wiper 11 and fed further may be fed through any suitable distribution means. However, the liquid may be applied onto the web of material in a continuous stream as shown in FIG. 1 or in individual compact streams as shown in FIG. 2. Furthermore, this liquid may be applied to the web of goods by rotating bands, or the like, as is generally known, or may be dispersed into drops and applied in this manner. FIGS. 6 and 7 show, how it is possible even with a pair-like combination of adjacent roller teeth, for one to obtain a stripe-like pattern, wherein one color alternates in one stripe with another color. This is effected by coupling the hoses onto the hose connections 16 in cross-like fashion, as can be seen from the drawings, and from which the liquid is further fed to an application device wherein the liquid is applied in jets onto the web of goods.

FIG. 7 shows how this pattern is obtained when combining three teeth. These possibilities are very important because it would be extremely expensive to wipe each tooth individually with respect to the adjacent tooth. Hence, with the same effect the total device is more economical.

Thus, while only several embodiments of the present invention have been shown and described, it will be obvious to those persons of ordinary skill in the art, that many changes and modifications may be made thereunto, without departing from the spirit and scope of the invention.

What is claimed is:

1. A device for applying treatment liquids onto continuously-fed textile webs of the type including a liquid-supply container, at least one roller which is partially immersed in the liquid in the liquid-supply container for removing liquid therefrom and a wiper which wipes the liquid off a surface of the roller for subsequent feeding onto the web of goods, the improvement comprising:

said at least one roller having a profiled surface and said wiper having a complementary-configured wiper edge which positively engages said profiled surface of said roller, said profiled surface defined by tooth-like wiping surfaces with each tooth-like surface having two opposed tapering tooth flanks which merge into a circumferential edge portion.

2. The device according to claim 1, wherein said roller is provided with a plurality of V-shaped wiping surfaces.

3. The device according to claim 2, wherein said roller is composed of individual parts each of which contain a single wiping surface.

4. The device according to claim 2 wherein said wiper includes a plurality cup-shaped wiper elements each of which is associated with and at least partially encompasses a single wiping surface.

5. The device according to claim 4, wherein said wiper has a free end provided with a hose coupling.

6. The device according to claim 2, wherein plural liquid-supply containers for the treatment liquid are provided for said roller, each of which is associated with at least one of said wiping surfaces.

7. The device according to claim 6, wherein the liquid level in said liquid-supply containers is adjustable to different heights.

8. The device according to claim 6, wherein the liquid level of adjacent liquid-supply containers may be adjusted to different heights.

9. The device according to claim 2, wherein said wiping surfaces are separated in a plurality of adjacent sets of wiping surfaces and wherein separate liquid-supply containers for treatment liquid are provided for each of the plurality of adjacent wiping surfaces.

10. The device according to claim 6 or 9, wherein said device includes a unitary container provided with lateral separating walls for defining a plurality of compartments, the latter which serve as said liquid-supply containers.

11. The device according to claim 6 or 9, wherein the liquid-supply containers intended to contain the same type of liquids are coupled with each other over the total width of said roller.

12. The device according to claim 1, wherein the immersion depth for said roller into the treatment liquid is variable.

13. The device according to claim 1, wherein said roller is adjustable in a vertical direction.

* * * * *